US005573109A

United States Patent [19]

Isacson

[11] Patent Number: 5,573,109

[45] Date of Patent: Nov. 12, 1996

[54] MULTI-FUNCTION CONTAINER WITH A LIGHT SOURCE

[76] Inventor: Bruce P. Isacson, 4533 Gentry Ave., Studio City, Calif. 91607

[21] Appl. No.: 217,686

[22] Filed: Mar. 25, 1994

Related U.S. Application Data

[63] Continuation-in-part of Ser. No. 100,505, Jul. 20, 1993, Pat. No. 5,318,177.

[51] Int. Cl.[6] ..... A61J 1/00; B65D 85/58; F21V 33/00

[52] U.S. Cl. ..... 206/38.1; 206/0.81; 206/540; 362/116; 362/154; 362/253; 368/10

[58] Field of Search ..... 206/38, 38.1, 0.81, 206/39.6, 459.1, 459.5, 528, 534–540; 362/116, 154–156, 202, 253; 368/10

[56] References Cited

U.S. PATENT DOCUMENTS

| | | | |
|---|---|---|---|
| 1,280,300 | 10/1918 | Recker . | |
| 4,153,927 | 5/1979 | Owens | 372/99 |
| 4,223,801 | 9/1980 | Carlson | 221/3 |
| 4,305,118 | 12/1981 | Paquette . | |
| 4,314,317 | 2/1982 | Robson . | |
| 4,526,474 | 7/1985 | Simon | 368/10 |
| 4,765,459 | 8/1988 | Edwards | 206/38.1 |
| 4,864,474 | 9/1989 | Maglica | 362/203 |
| 4,888,667 | 12/1989 | Hwang . | |
| 4,914,748 | 4/1990 | Schlotter, IV et al. | 362/109 |
| 4,936,444 | 6/1990 | Yamaki | 206/38 |
| 5,008,784 | 4/1991 | Wang . | |
| 5,086,377 | 2/1992 | Roberts | 362/102 |

FOREIGN PATENT DOCUMENTS

| | | |
|---|---|---|
| 498051 | 1/1951 | Belgium . |
| 989369 | 5/1976 | Canada . |
| 8536618 | 5/1986 | Germany . |
| 402164 | 11/1933 | United Kingdom . |
| 2227825 | 8/1990 | United Kingdom . |

OTHER PUBLICATIONS

PCT International Search Report, Nov. 7, 1994, pp. 1–3 PCT/US94/06221.

Product order form, American Airlines magazine "American Way", Sep. 1993, Item 1. KeyLight™.

Brookstone catalog, undated, p. 18, Item 6. Lighted Pepper Mill.

Two ads of The Bakertowne Co. Inc., "Touch of Cheese" electronic lighted cheese grater, undated.

*Primary Examiner*—Jimmy G. Foster

*Attorney, Agent, or Firm*—Pretty, Schroeder, Brueggemann & Clark

[57] ABSTRACT

A multi-function container includes a housing, a closure and an exterior light source. The container has a first interior portion adapted to hold small items. The closure is used to cover the first interior portion of the housing and to contain the small items in the first interior portion of the housing. The housing also has a second separate interior portion adapted to hold a battery. The light source is operatively coupled to the second interior portion to receive power from the battery, upon the battery being held within the second interior portion. Thus, the multi-function container may serve as a container and/or a flashlight. The multi-function container may also include a key ring which is coupled to an exterior surface of the closure, and may also include a clock coupled to the side of the housing.

3 Claims, 12 Drawing Sheets

MULTI-FUNCTION CONTAINER WITH A LIGHT SOURCE

RELATED APPLICATIONS

This is a continuation-in-part of U.S. patent application Ser. No. 08/100,505 filed on Jul. 20, 1993, now U.S. Pat. No. 5,318,177.

FIELD OF THE INVENTION

This invention relates to multi-function containers for holding small items and, in particular embodiments, a container for holding medicine tablets or candy and which also has a light source. The invention also relates to multi-function containers for holding specialized items such as perfume, make-up kits and survival items combined with light sources and radios.

BACKGROUND OF THE INVENTION

Traditionally, medicine tablets have been dispensed in small containers, which come in various shapes and sizes. In smaller sizes, which normally contain around 10 tablets, medicine tablet containers can be conveniently carried in purses or pockets. The containers can be cylindrical and have a diameter which is slightly greater than the contained tablets. To seal the containers, many of them use a screw on or friction fit top to allow for safe storage. Moreover, many containers have been designed with childproof caps.

Another common type of medicine tablet container is a small hinged box that hold groups of medicine tablets in layers. This provides the container with a flat profile in one direction that aids in allowing the container to be placed in the purse or pocket. These containers have a single use, to hold medicine tablets. Once the medicine tablets are used up, the container is discarded or refilled with new medicine tablets.

Typically, small medicine tablet containers can be difficult to locate in a purse or a pocket. Moreover, considering the number of articles which may be carried by a typical person in a purse or a jacket (e.g., house and car keys, wallets, coins, tissues, to name just a few), a medicine tablet container can take up pocket or purse space that may be at a premium.

Other articles that may be carried in pockets or purses include small flashlights (often called penlights). However, like medicine tablet containers, these flashlights take up valuable pocket or purse space. Therefore, the space problem is compounded when one must also carry a medicine tablet container and the additional articles as discussed above.

Key rings are another relatively common article that is carried by the typical person to organize keys. Key rings are often attached to a charm or other ornament to enhance their aesthetic appeal, and key rings have been attached to small flashlights, such as penlights.

There are several drawbacks to using these above-described individual articles. Typically, these articles only perform a single function, and this requires the typical person to carry multiple articles to perform multiple functions. Moreover, a typical person must handle several articles, which are typically not designed to work with each other, at the same time in order to perform multiple functions. Additionally, each individual article takes up a portion of the limited space available in a pocket or a purse. Thus, a user must often decide which single-function articles they will take when space is at a premium, and they must also prioritize and decide which functions have to be given up. Therefore, there is a need in the consuming public for a space saving device which has multiple functions.

SUMMARY OF THE DISCLOSURE

It is an object of an embodiment of the present invention to provide an improved multi-function container, which obviates for practical purposes the above-mentioned limitations and fills the needs of the consuming public.

According to an embodiment of the invention, a multi-function container for holding small items and a battery includes a housing with first and second interior portions separated by a barrier, a closure and a light source. The first interior portion is adapted to hold small items, and the second interior portion is adapted to hold the battery. The closure is used to cover the first interior portion of the housing and contain the small items in the first interior portion of the housing. The light source is operatively coupled to the second interior portion to receive power from the battery, upon the battery being held within the second interior portion. Thus, the multifunction container may serve as a container and/or a flashlight. In a preferred embodiment, the multi-function container also includes a key ring which is coupled to an exterior surface of the closure.

In another embodiment of the present invention, the light source has an on-off switch. Moreover, the battery comprises at least one flat, disk-shaped battery. In further embodiments, the light source and battery are adapted to be decoupled from the housing when providing light.

In a further embodiment of the present invention, the housing is cylindrical and has two ends opposite one another, such that the first and second interior portions are at opposite ends of the housing. In this embodiment, the closure is coupled to the housing by frictional contact between the closure and the housing, by threads on the closure and the housing or the like.

In a still further embodiment of the present invention, the housing is rectangular and box-shaped, and the housing has a top and a side. In this embodiment, the first interior portion is located on the side of the housing and the second interior portion is located on the top of the housing. Preferably, the closure is coupled to an edge of the side of the box-shaped housing to cover the first interior portion on the side of the housing.

In particular embodiments of the present invention, the container includes a clock coupled to the side of the housing, and in preferred embodiments, the clock also contains an alarm.

Other features and advantages of the invention will become apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF THE PREFERRED EMBODIMENTS

Figure 1:
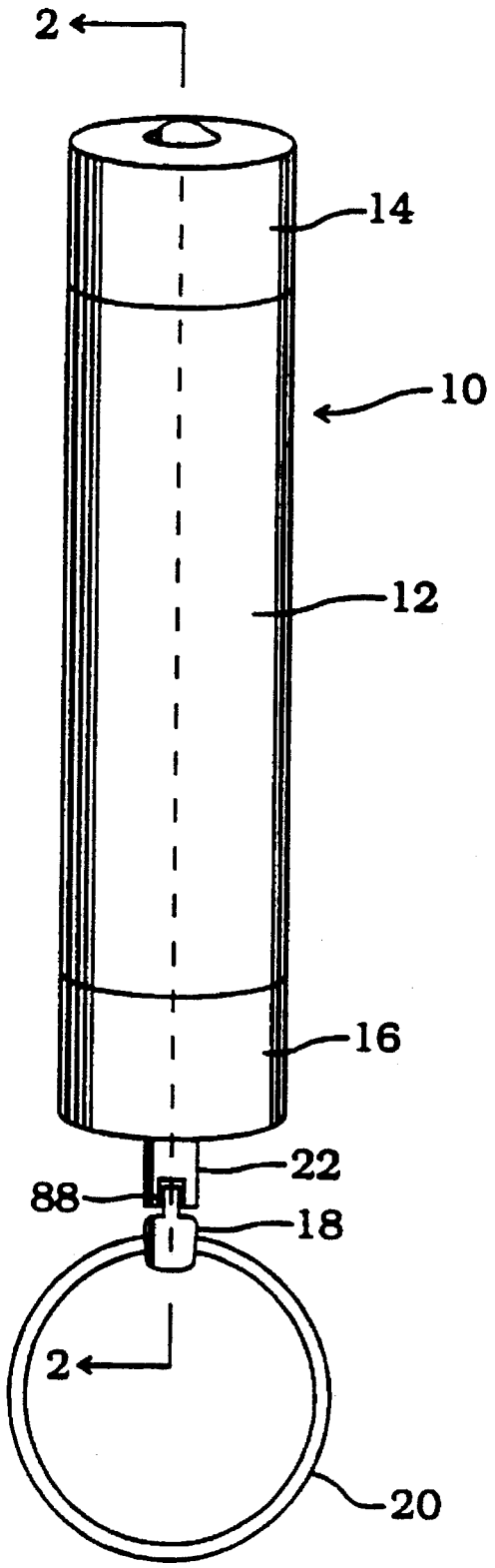
FIG. 1 is a perspective view of a multi-function container with a light source in accordance with a first embodiment of the present invention.

As shown in the drawings for purposes of illustration, the invention is embodied in a multi-function container. In preferred embodiments of the present invention, the multi-function container may hold medicine tablets, and may have a light source and a key ring coupled to the container. However, it will be recognized that further embodiments of the invention may be used to carry other small items, such as candy, coins, money, perfume, makeup, survival kits, pencils or other small objects, and the container may be coupled with other articles, such as charms, wallets, clocks, pocket knives or the like to provide additional functions.

The combining of several single function articles into a single multi-function container has several advantages. First, the amount of space required is reduced compared to the space required for a plurality of single function articles, since the multiple functions reside within a single article. This can make the article easier to find, since the user will have to sort through less articles to find the one with the desired function. Second, the multiple functions of the single article cooperate with each other, so as to enhance the usefulness of each individual function and to allow a user to more easily use the multi-function article as compared to a plurality of articles which each perform single functions. For instance, the user can open the container and pour out some tablets, and then readily use the multi-function container to light up the tablets. This allows the user to visually verify the number and kind of tablets removed or remaining in the container. This is quicker and easier than opening a separate container, removing the tablets, putting the container out of the away, finding a flashlight, and then illuminating the tablets. Additionally, a clock may be coupled to the container and used to indicate when to take a tablet. The clock could provide an audible alarm or the time could be viewed with or without illumination from the multifunction container. In another example, the user can hold the multi-function container and use the light to illuminate a darkened lock with a key hole as they insert a key held on the attached key ring. Thus, the user does not have to find a separate flashlight and key ring, or fumble around without a flashlight while trying to insert a key in the dark.

FIG. 1 shows a first embodiment of a multi-function container 10 in accordance with a first embodiment of the present invention. The illustrated multi-function container 10 includes a cylindrical container portion 12, a light source 14, a closure 16, and a key ring support member 18 which is coupled to a key ring 20. The closure cap 16 is attached to a mounting member 22 which is in turn coupled to the key ring support member 18 by a pin 24.

In preferred embodiments, the cylindrical housing 12 is dimensioned so as to carry a limited number of tablets (e.g., ten tablets). This allows the user to carry enough tablets (or candy or other items) for an emergency or limited duration use, while still maintaining a relatively small container size. However, in further embodiments, the housing is dimensioned to hold more or less tablets. Preferably, the housing 12 has a circular cross-section, because this makes the multi-function container easier to grip in one hand and allows the container to hold disk-shaped tablets in a column. However, in other embodiments, the cylindrical housing 12 has other cross-sectional shapes, such as squares, rectangles, triangles, and ovals, to accommodate different tablet sizes and shapes.

The light source 14 is designed to provide an exterior light that can illuminate small areas. Various embodiments of the light source provide wide beams, narrow beams, diffuse beams or a combination of beams which are selectable by the user. Preferably, the light source provides substantially white light; however, in further embodiments the light source provides a colored light. As illustrated, the key ring support 18 is designed to hold a key ring 20 which can support a plurality of keys.

Figure 2A:
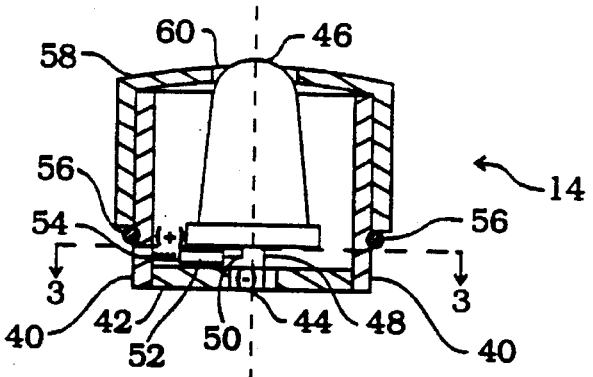
FIGS. 2(*a*)–2(*c*) are cross-sectional views of the first embodiment along the line 2—2 shown in FIG. 1.
Figure 2B:
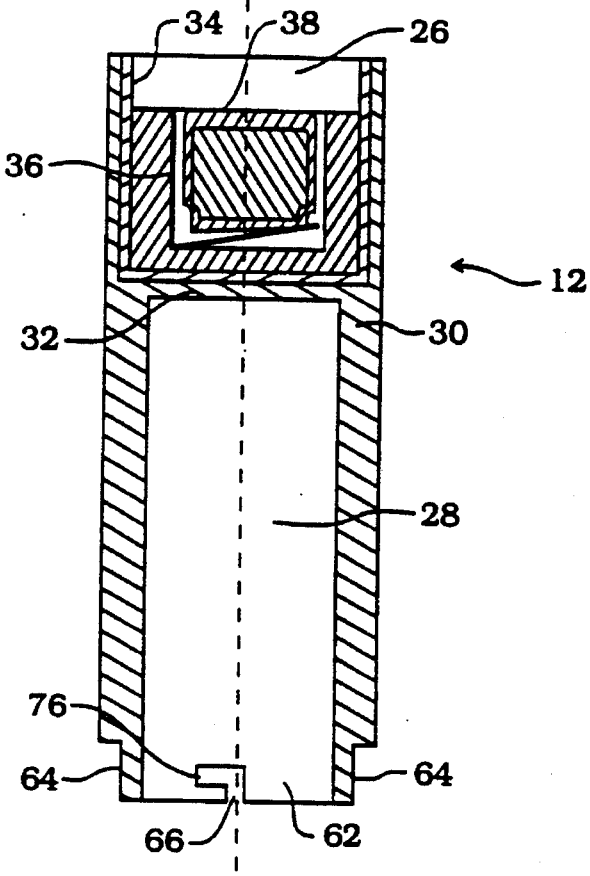
Figure 2C:
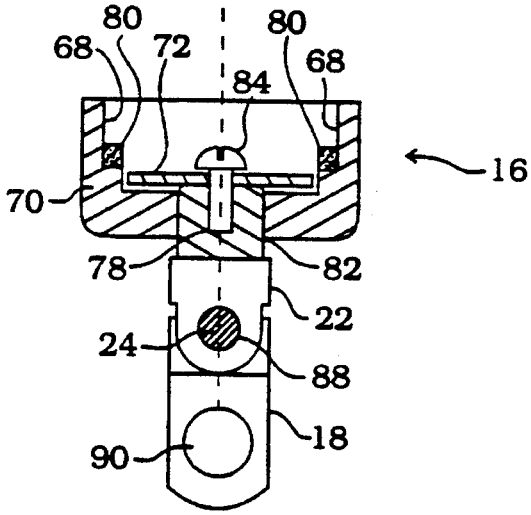
Figure 3:
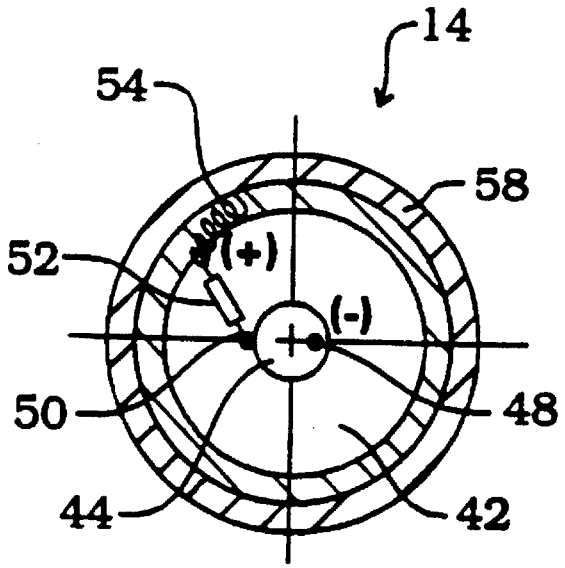
FIG. 3 is a cross-sectional view of the first embodiment along the line 3—3 shown in FIG. 2(*a*).
Figure 4:
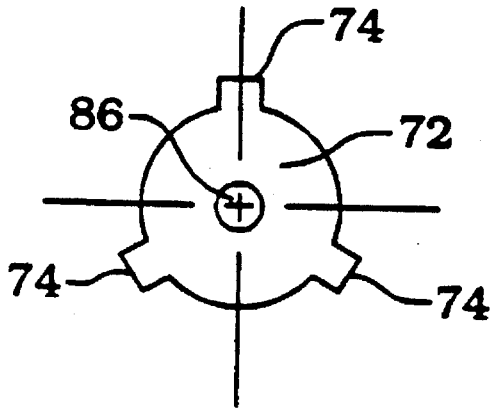
FIG. 4 is a top perspective view of the lock plate shown in FIG. 2(*c*).

FIGS. 2–4 illustrate the construction of the multi-function container 10 in accordance with the first embodiment of the present invention. FIGS. 2(*a*)–2(*c*) show a cross-sectional view of the cylindrical housing portion 12, the light source 14, and the closure 16, as viewed along the line 2—2 in FIG. 1. FIG. 3 shows a cross-sectional view of the light source 14, as viewed along the line 3—3 in FIG. 2(*a*), and FIG. 4 shows a top view of a lock plate used in the closure 16 in FIG. 2(*c*).

The cylindrical housing portion 12, as shown in FIG. 2(*b*), includes a battery housing 26 and a tablet holding portion 28. The battery housing 26 and tablet holding portion 28 are held together by a shell 30, and are separated from each other by an end barrier 32. The shell 30 and end barrier 32 are preferably formed as a single, integral structure, such as by injection molding or other suitable process, for ease of manufacture. However, other embodiments are formed as separate pieces that are secured together by other methods, such as by welding, gluing, or the like. In preferred embodiments, the shell 30 and end barrier 32 are formed from plastic, such as high impact polystyrene, polycarbonate, poly-propylene, ABS plastic, sterile medical plastics or the like. However, other embodiments are formed from metals, such as gold, silver, stainless steel, aluminum or the like; ceramics or a combination of these materials or other suitable materials. In further embodiments, the shell 30 and end barrier 32 are made out of FDA approved materials.

FIG. 2(*b*) shows that the illustrated battery housing 26 includes a female threaded insert 34, a contact strip 36 and a battery 38. FIG. 2(*a*) shows that the light source 14 includes a male threaded insert 40, insulated cover piece 42, a contact pin 44, a lamp 46 with negative contact 48 and positive contact 50, limiting resistor 52, metal spring 54, and O-ring 56. The female threaded insert 34 of the battery housing 26 couples with the male threaded insert 40 on the light source 14. As the light source 14 is threaded into the female insert 34, the insulated cover piece 42 and the contact pin 44 of the male insert 40 contact a top surface and a positive contact of a battery 38. The contact pin 44 forms an electrical connection between the battery 38 and the negative contact 48 of the lamp 46.

As shown in FIGS. 2(*a*) and 3, the positive contact 50 of the lamp 46 is connected to the current limiting resistor 52 which is connected to a small metal spring 54 that makes electrical contact with the male threaded insert 40. The male threaded insert 40 contacts one end of a contact strip 36 in the battery housing 26, while the other end of the contact strip 36 contacts a negative terminal of the battery 38. To activate the lamp 46 in the illustrated embodiment, the threaded male insert 40 is threaded into insert 34 until electrical contact is made between the male insert 40 and the contact strip 36. To deactivate the lamp 46, the male insert is unscrewed (or unthreaded) slightly to disengage the male insert from the contact strip 36. The seal between the light source 14 and the battery housing 26 is maintained by an O-ring 56, which serves to prevent loosening of the light source 14 and also prevents electrical contact between the male insert 40 and the contact strip 36 until the light source 14 is threaded all the way into the battery housing 26 and activated. In other embodiments, the male insert 40 has at least one protrusion extending from and formed on the surface of the male insert 40 and the female insert 34 has at least two correspondingly shaped notches formed at predetermined spacings around the surface of the female insert 34 to receive the protrusion on the male insert 34 and to hold the light source 14 in the on-state or the off-state.

In preferred embodiments, the metal electrical contacts are made of electrically conductive metal, having minimal corrosive characteristic, such as brass. However, in further embodiments, the metal electrical contacts are made out of other electrical materials, such as copper, aluminum or the like. Moreover, the illustrated battery 38 is a single flat, disk-shaped battery of the type typically used in watches or calculators, which allows the light source 14 to be relatively small. However, in further embodiments, a plurality of flat, disk-shaped batteries or other types of batteries are used. The lamp 46 is preferably an LED (light emitting diode) type light source which has a relatively low energy consumption rate and which provides a focused beam of substantially white light suitable for use as a penlight. However, in further embodiments, colored LEDs or other suitable lamps or illuminating devices are used. Moreover, while the light source 14 in the above-described preferred embodiment is activated by a twisting motion, other embodiments of the light source are activated by other suitable means, such as a multi-position switch, squeeze contacts or the like. In still further embodiments, the light source 14 and battery housing 26 are removable from the shell 30, so that the light source 14 can be operated when decoupled from the multi-function container 10.

The male insert 40 of the light source 14 is held, by welds, adhesives or the like, in an outer shell 58. The outer shell 58 has a diameter which matches the shell 30, and it is made of the same materials as the shell 30 in the cylindrical housing portion 12 to provide a smooth finish and smooth joint between the light source 14 and the cylindrical housing portion 12. However, in other embodiments the outer shell 58 is made of different materials than the shell 30 and does not have a smooth finish. This can increase friction or provide an overall container shape that is easier for the user to hold.

The outer shell 58 has a lamp outlet hole 60 that allows the lamp 46 to emit light from the light source 14. In preferred embodiments, the outlet hole 60 may permit the lamp 46 to extend beyond the shell 58 as shown in FIG. 2(*a*). In other embodiments, the outlet hole 60 holds a lens (not shown) for providing focused light beams. Moreover, in further embodiments, the outlet hole 60 holds filters (not shown) for altering the color of the light source 14.

The tablet holding portion 28 of the cylindrical housing portion 12 is shown as being made of a unitary structural shell 30. However, in other embodiments, the tablet holding portion 28 may contain an additional insert shell (not shown) to provide additional protection or insulation for the tablets. An internal insert may be desirable, for example, if a metal shell 30 and end barrier 32 is used. The insert would minimize the risk of chemical reactions between the metal and the tablets.

The cylindrical housing portion 12, as shown in FIG. 2(*b*), includes an open end 62 which opens into the tablet holding portion 28, a smooth male connecting portion 64, and notches 66. As shown in FIG. 2(*c*), the closure cap 16 includes a smooth female connecting portion 68, and outer shell 70, and a lock plate 72. The open end 62 is capable of being closed by the closure cap 16 as shown in FIGS. 1 and 2. In the illustrated embodiment, the shell 30 is recessed to form the smooth male connecting portion 64 which is formed to couple with the smooth female connecting portion 68 formed in the outer shell 70 of the closure cap 16. The locking notches 66 of the tablet holding portion 28 are used with the lock plate 72 to hold the closure cap 16 securely and seal the open end 62 of the tablet holding portion 28. As shown in FIG. 4, the lock plate 72 has teeth 74 which engage locking portions 76 of the notches 66 to lock the closure cap 16 in position.

The closed end of the outer shell 70 of the closure cap 16 includes a passage 78 to allow the mounting member 22 to pass through the closure cap 16, and a gasket 80. The mounting member 22 includes a threaded screw hole 82. The mounting member 22 is secured to the closure cap 16 through the passage 78 by a screw 84 passing through a hole 86 in the lock plate 72 and threaded into the threaded screw hole 82. To secure the closure cap 16 to the tablet holding portion 28, the closure cap 16 is placed over the open end 62 and male connecting member 64, and pressed against the outer shell 30 of the cylindrical housing portion 12. The mounting member 22 is then rotated to cause the teeth 74 of the lock plate 72 to engage the notches 66. Next, the closure cap 16 is pressed firmly against the shell 30 to compress the gasket 80 made of sponge, rubber, plastic or the like, attached to the closure cap 16. Compression of the gasket 80 forms a seal and allows the teeth 74 of the lock plate 72 to lock into the locking portions 76 of the notches 66. Because the closure cap 16 requires the mounting member 22 to be rotated to engage the notches 66, the illustrated closure cap 16 reduces the risk of accidental or unintended opening of the multi-function container 10.

In further embodiments, other well known closure devices (such as those purported by others to be "child resistant") are used. Moreover, in still further embodiments, other closure cap securing methods, such as threads, friction fits, snap fits or the like, are used to secure the closure cap 16 to the cylindrical housing portion 12 to accommodate easy open and closing. Preferably, the outer shell 70 of the closure cap 16 matches the diameter of the shell 30 and is made of the same material as the shell 30 in the cylindrical housing portion 12 to provide a smooth finish and joint between the closure cap 16 and the cylindrical housing portion 12. However, in other embodiments, the outer shell 70 is made of different materials than the shell 30 and does not have a smooth finish. This can increase friction or provide an overall container shape that is easier for the user to hold.

Preferably, the mounting member 22 of the closure cap 16 is coupled to the key ring support member 18 by a pin 20 passing though pin holes 88 in the mounting member 22 and key ring support member 18. However, in further embodiments, the key ring support member 18 is secured to the mounting member 22 by other suitable means, such as nuts and bolts, rivets, cotter pins or the like. The key ring support member 18 also has a key ring hole 90 which is used to support and secure a key ring 20. However, in other embodiments, the key ring hole 90 is not limited to receiving key rings; it also or alternatively receives stretch bands, necklaces, bracelets, or other devices.

In other embodiments, the cylindrical housing portion 12 is formed with one or more pockets on the exterior surface of the shell 30. The one or more pockets are shaped to hold small items or articles, such as toothpicks, tweezers, scissors or the like. In alternative embodiments, the cylindrical housing portion is formed with one or more grooves or slots on the exterior surface of the shell 30. The one or more grooves or slots may be coupled to small articles, such as toothpicks, tweezers, scissors or the like. In further embodiments, the closure cap 16 has a spoon, fork, tweezers or the like coupled to the inside of the closure cap 16 to allow the user to handle the small items contained in the multi-function container 10.

In preferred embodiments of the present invention, the overall length of the multi-function container 10 is preferably less than or equal to 3.0 inches and the overall diameter is preferably less than or equal to 0.75 inches. These dimensions allow the container 10 to be readily portable and readily carried in a user's pocket, purse, glove compartment, children's school bag, around a user's neck as a necklace or the like. However, further embodiments are larger or smaller.

In use, the user can quickly locate the multi-function container 10 in a pocket or purse, because a single article is typically easier to locate than a plurality of single function items. Preferably, the user holds the multi-function container 10 in one hand, and uses the other hand to activate or use one or more functions of the container 10. For example, the user may hold the multi-function container in one hand, while using the other hand to remove the closure cap 16 and hold tablets poured from the tablet holding portion 28. With the thumb and/or fingers of the one hand holding the container 10, the may then twist and activate the light source 14 to illuminate the tablets held in the other hand, e.g., to verify the number and type of tablets poured out of the container 10. Moreover, the light source can be used to illuminate instructions on how to use the tablets or read other material in darkened areas. Furthermore, if the light source 14 is removable, the light source 14 can be used to illuminate the tablets still contained inside the tablet holding portion 28. Thus, the light source 14 and the tablet holding portion 28, together in a single, easy-to-hold housing, cooperate with each other to enhance their individual usefulness.

In another example, the user can illuminate a darkened lock and key hole by twisting, activating and aiming the light source 14 at the lock, while placing the key in the lock. For example, if the key ring 20 is coupled to the key ring support member 18 by a stretch band or cord, the key ring and keys may be easily bent around and placed in the key hole which is illuminated by the light source 14. In some cases, it may be easier to remove either the light source 14 or the closure cap 16 and attached key ring 20. Also, the light source 14 can be used as a safety light to indicate a user's presence as they walk through dark areas to a car, building or the like.

Figure 5:
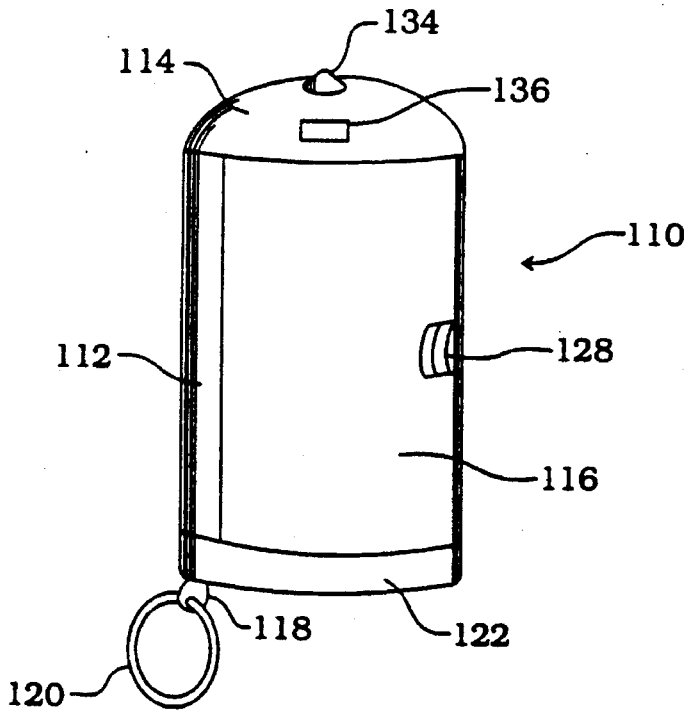
FIG. 5 is a perspective view of a multi-function container with a light source in accordance with a second embodiment of the present invention.
Figure 6:
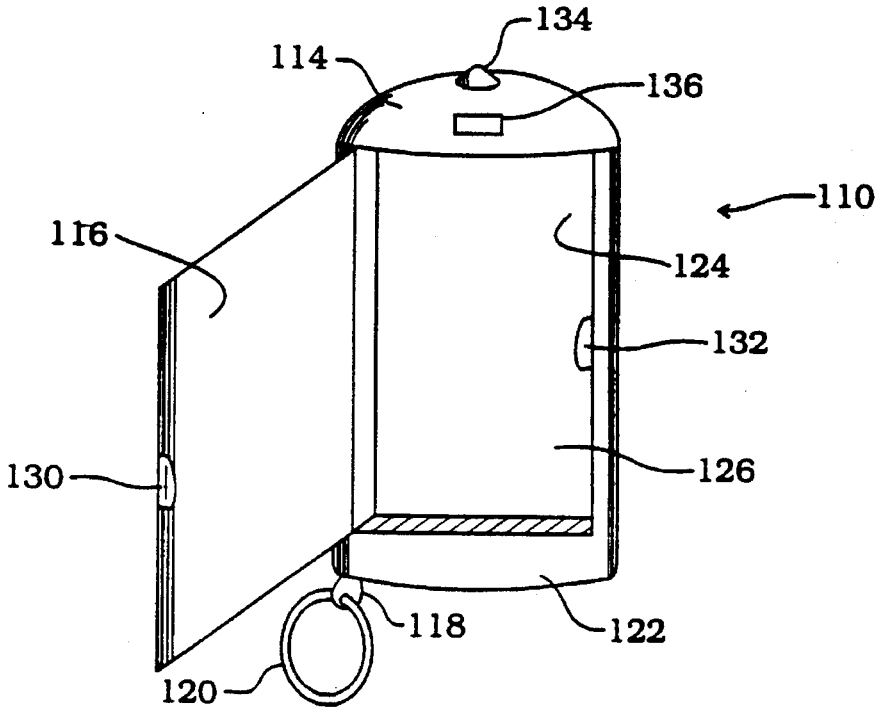
FIG. 6 is a perspective view of the second embodiment shown in FIG. 5 in an open condition.

FIGS. 5 and 6 illustrate a multi-function container 110 in accordance with a second embodiment of the present invention. The multi-function container 110 includes a rectangular, box-shaped housing portion 112, a light source 114, a closure panel 116 and a key ring support member 118. The key ring support member 118 is coupled to a key ring 120 and a mounting portion 122 of the box-shaped housing portion 112.

In the FIGS. 5 and 6 embodiment, the closure panel 116 covers and seals an opening 124 into a tablet holding compartment 126 in the box-shaped housing portion 112. Preferably, the closure panel 116 is connected by hinges along an edge of the opening 124, and opens and closes like a book. In another embodiment, the closure panel 116 is formed as an integral part of the boxed-shaped housing portion 112, and bends along a crease formed between the panel 116 and housing portion 112. However, in further embodiments, other closure methods, such as sliding panels, friction fit panels or the like, are used.

To aid in opening the closure panel 116, the outer surface of the panel 116 preferably has finger grooves 128. In preferred embodiments, the closure panel 116 is held in the closed position by friction between matched lock tabs 130 and 132. To open the multi-function container 110, the user engages a fingernail or the like in the finger grooves 128 and applies sufficient force to overcome the restraining force applied by the lock tab 132 on the matched lock tab 130. To close and secure the closure panel 116, the user presses down on the closure panel 116 until the lock tab 132 engages and seats in the matched lock tab 130. In other embodiments, other locking methods are used, such as spring-loaded catches, snap fittings, frictional contacts, pins or the like.

The tablet holding compartment 126 in the rectangular, box-shaped housing portion 112 allows the multi-function container 110 to more easily hold a variety of different shaped tablets, either separately or in combination. In further embodiments, a plurality of sub-compartments are placed inside the tablet holding compartment 126 to allow segregation and organization of a plurality of different tablet sizes or types that are held together at the same time.

In the second embodiment, a lamp 134 in the light source 114 is activated by a light switch 136. The lamp 134 may remain in an on state as long as the light switch 136 is continuously depressed. This saves power consumption, since the lamp 134 only remains on while the light switch is depressed. In an alternative embodiment, the light source 114 does not have a visible light switch 136, rather electrical contacts are contained between layers in the light source 114 and/or the box-shaped housing portion 112 and is activated by squeezing the multi-function container 110 between a user's fingers to cause the electrical contacts to close the circuit. However, in further embodiments, a multiple position light switch 136 is used, where the on-state or off-state of the lamp 134 is determined by the position of the light switch 136 and not by whether the light switch 136 is continually depressed.

In other embodiments, the multi-function container 110 is made out of the same materials or incorporates any of the alternative features which were previously described above with the multi-function container 10. The illustrated multi-function container 110 is shown with an attached key ring 120; however, articles other than key rings 120 may also be attached. This embodiment, like the previously described embodiment, holds medicine tablets, candy or other small items.

Figure 7:
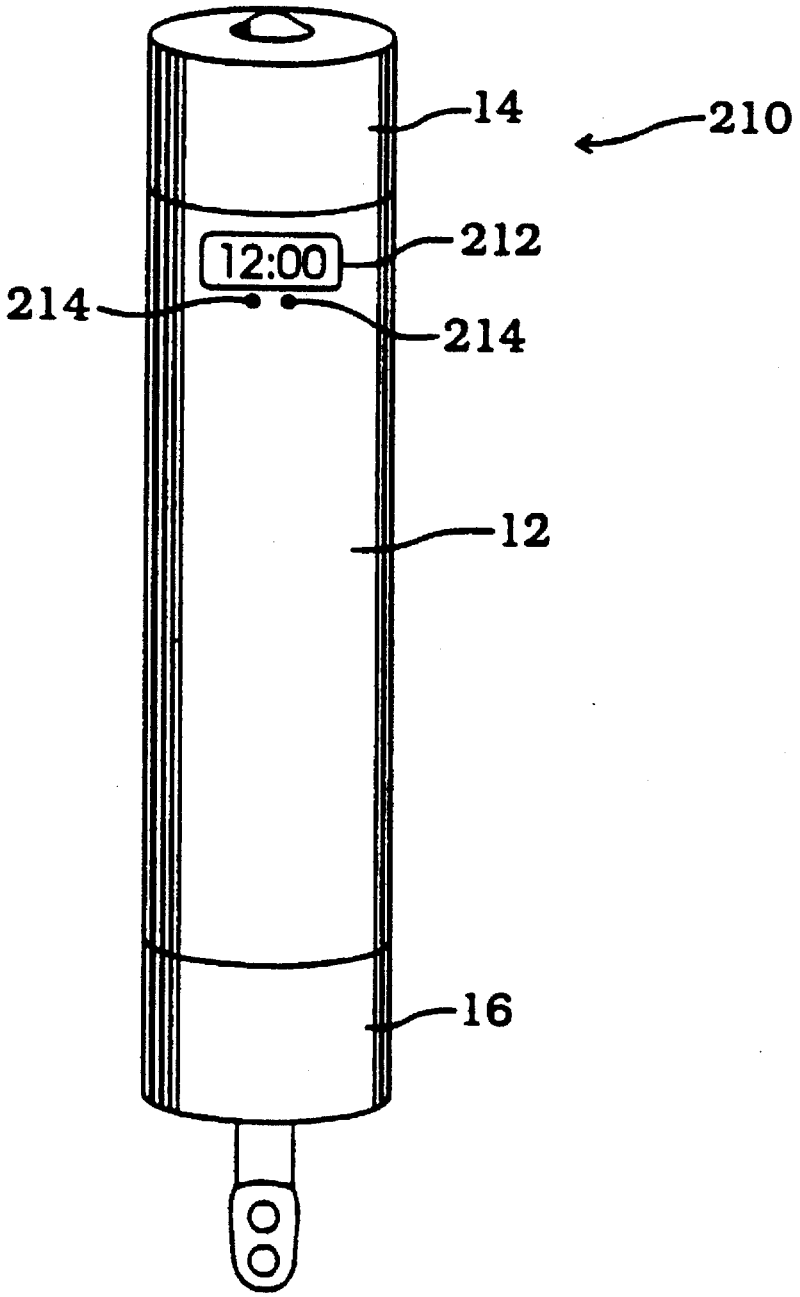
FIG. 7 is a perspective view of a multi-function container with a light source in accordance with a third embodiment of the present invention.

FIG. 7 shows a multi-function container 210 in accordance with a third embodiment of the present invention, which includes a clock 212 mounted on the side of the cylindrical housing portion 12. Preferably, the clock 212 is mounted close to the power source for the light source 14, such that power for the clock 212 is shared with the light source 14. However, in alternative embodiments, the clock 212 has its own power source.

In preferred embodiments, the clock 212 uses an LCD (liquid crystal display) to display the current time and date, and has a plurality of clock setting buttons 214. In alternative embodiments, the clock 212 display uses LEDs, fluorescent characters, analog hands or the like, dependent on the use of the container 210. The clock 212 is set by the plurality of clock setting buttons 214 in a manner similar to that used to set time on an LCD watch. However, in alternative embodiments, other methods of setting the time, such as knobs or the like are used. Preferred functions that are provided by the clock 212 are time, a.m. or p.m. indications, seconds, date, stopwatch functions and alarm functions. However, other embodiments have more or less clock functions. Moreover, the use of the clock 212 may be used with any of the previously described embodiments.

The inclusion of a clock 212 has several advantages. It allows the multi-function container 210 to have an additional function and further reduce the number of individual items a user must carry. The clock 212 can replace the need for a separate time piece or alarm. In addition, the function of the clock cooperates with other functions of the container, so as to enhance the usefulness of such other functions. For instance, an alarm can be used to indicate when to take tablets held in the container 210.

Figure 8:
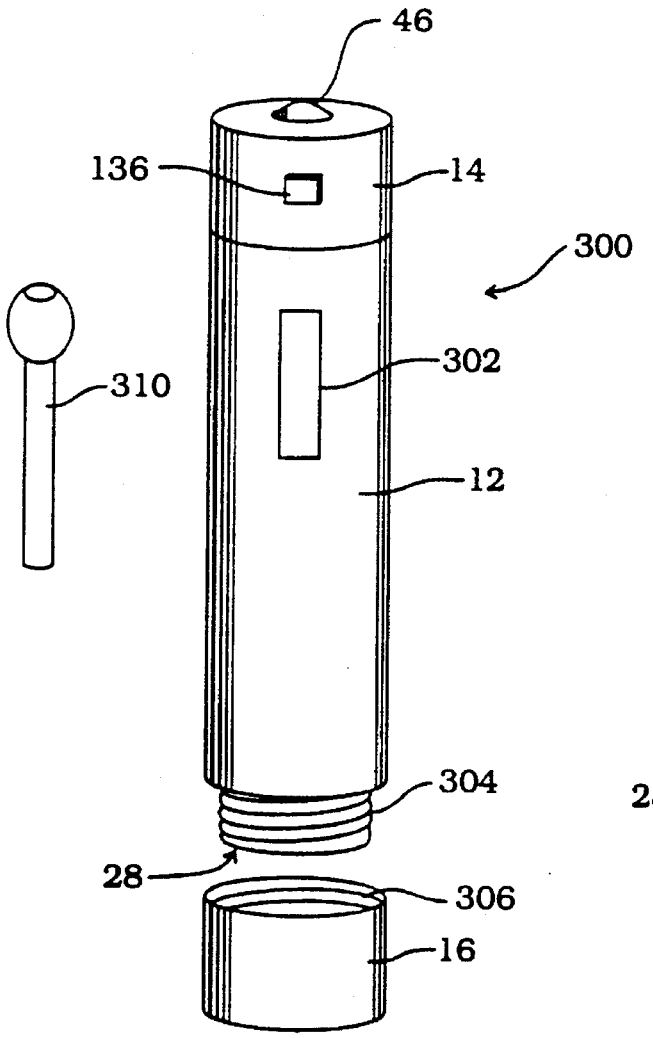
FIG. 8 is an exploded perspective view of a multi-function container with a light source in accordance with a fourth embodiment of the present invention.

FIG. 8 is an exploded perspective view of a multi-function container 300 with a light source 14 in accordance with a fourth embodiment of the present invention. The multi-function container 300 includes a cylindrical container portion 12, a light source 12, a closure cap 16, an article holding portion 28, and a lamp 46 as described above in the embodiments shown in FIGS. 1–4. However, in this embodiment a light switch 136 is used to activate the lamp 46, although in further embodiments, the light source 14 may be activated by twisting as previously described. Moreover, this embodiment is further adapted for carrying small items such as matches 310.

The multi-function container 300 includes a match strike strip 302, coupled to the cylindrical container portion 12, for igniting the matches 310 that were contained within the holding portion 28 of the cylindrical container portion 12. The cylindrical container portion 12 has threads 304 on the open end of the container portion 12 that correspond to threads 306 on the closure cap 16 to allow simple sealing and unsealing of the holding portion 28 containing the matches 310. The closure cap 16 is shown without a key ring holder or the like; however, in other embodiments, the closure cap 16 may be coupled to a key ring support or the like. This embodiment provides the ability to carry matches and to illuminate areas so that a user can more easily strike a match in dark locations.

Figure 9:
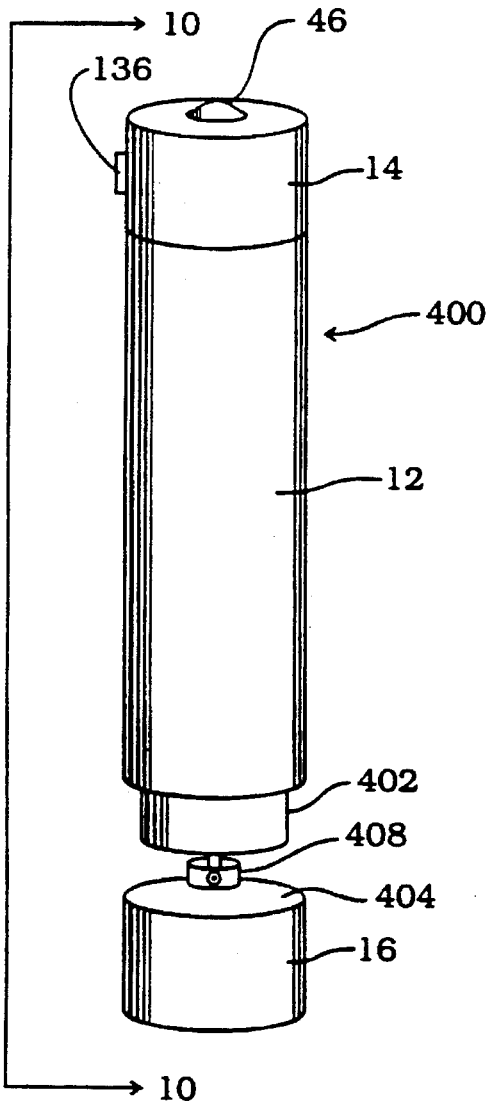
FIG. 9 is an exploded perspective view of a multi-function container with a light source in accordance with a fifth embodiment of the present invention.
Figure 10:
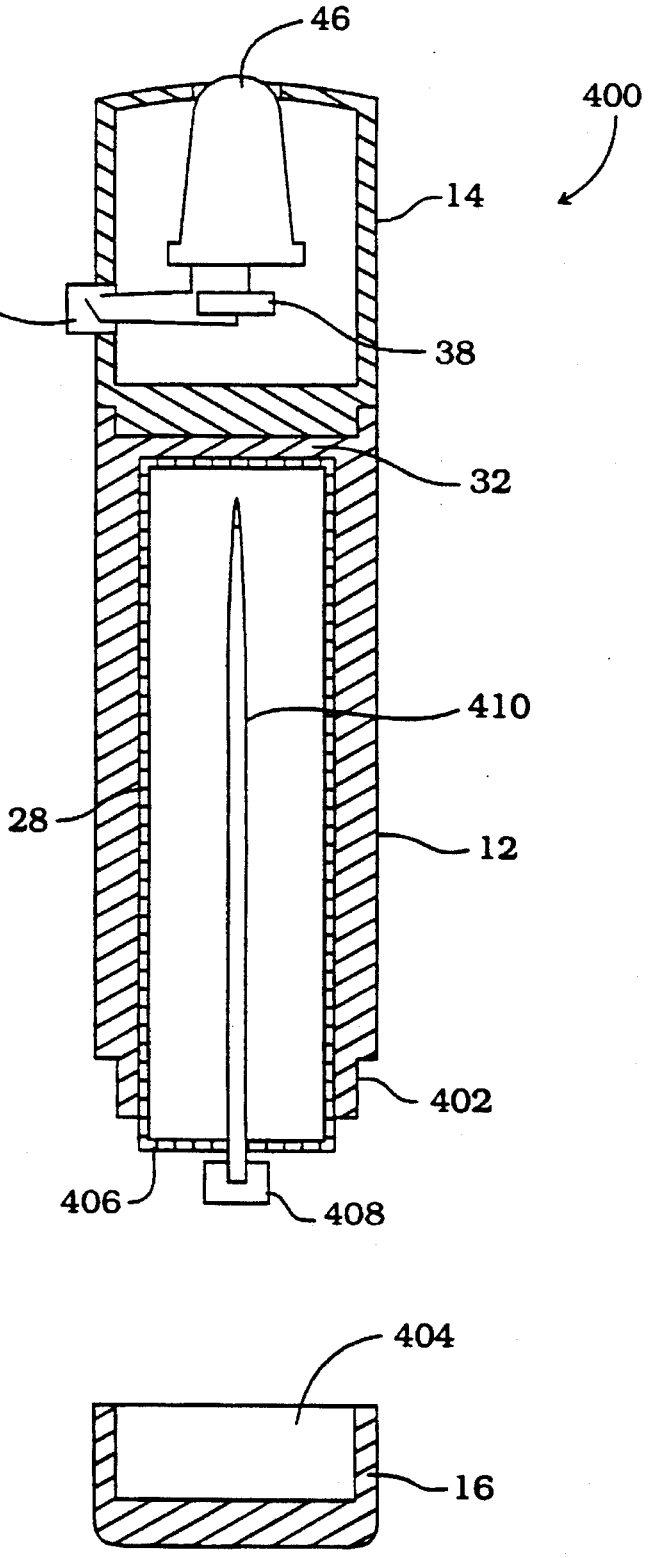
FIG. 10 is a cross-sectional view of the embodiment as shown along the line 10—10 in FIG. 9.

FIG. 9 is an exploded perspective view of a multi-function container 400 with a light source 14 in accordance with a fifth embodiment of the present invention, and FIG. 10 is a cross-sectional view of the embodiment as shown along the line 10—10 in FIG. 9. This embodiment is similar to the embodiments described above and includes a cylindrical container portion 12, a light source 14, a closure cap 16, a holding portion 28, a battery 38, a lamp 46 and a light switch 136. In this embodiment, the container portion 12 has smooth sides 402 at the open end of the container portion 12 that correspond to smooth sides 404 on the closure cap 16, so that closure cap 16 is coupled to the container portion 12 by friction. However, in alternative embodiments, the closure cap 16 may be coupled by threads or the like. The closure cap 16 is shown without a key ring holder or the like; however, in other embodiments, the container portion 12 may be coupled to a key ring support or the like. Positioning the holder on the container portion 12 would prevent inadvertent removal of the closure cap 16, when the closure cap 16 is secured only by friction.

The holding portion 28 of the multi-function container 400 is adapted to hold a bottle 406 containing a liquid, such as perfume or the like. The bottle 406 may be held inside the holding portion 28 by threads, friction, adhesives or the like. The bottle 406 includes a spray pump cap 408 and a delivery tube 410 to deliver the perfume contained in the bottle 406. An advantage to this embodiment is that the user can carry perfume and have a light source that can be used to touch up make-up or illuminate dark locations without having to carry two or more separate articles. In alternative embodiments, the multi-function container 400 may be sized to accommodate other liquids, such as alcohol, soft drinks, breath fresheners or the like, and adapted to accommodate bottles utilizing other fluid delivery systems, such as pressurized containers, twist cap containers or the like.

Figure 11:
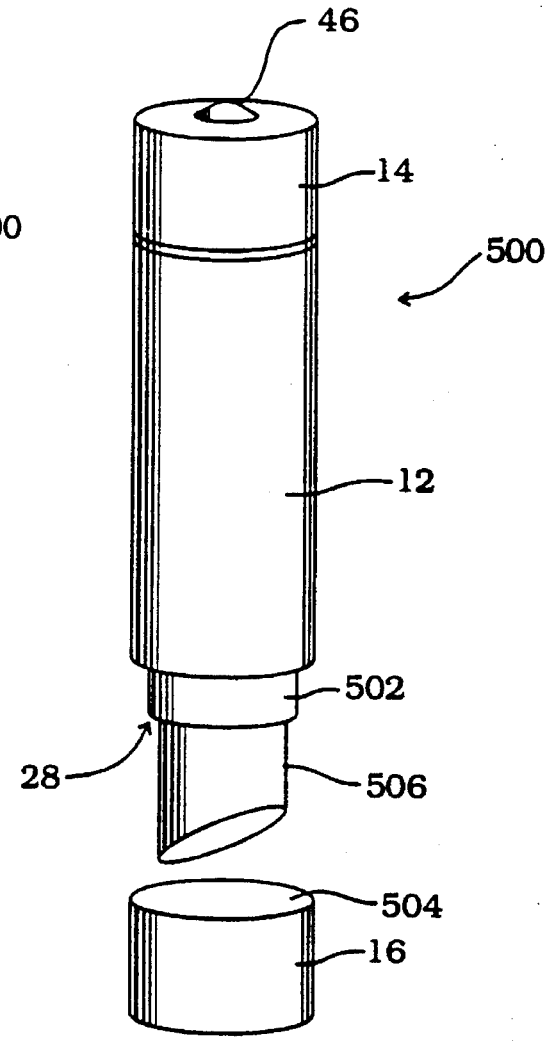
FIG. 11 is an exploded perspective view of a multi-function container with a light source in accordance with a sixth embodiment of the present invention.

FIG. 11 is an exploded perspective view of a multi-function container 500 with a light source 14 in accordance with a sixth embodiment of the present invention. This embodiment is similar to the embodiment described in FIGS. 9 and 10, and includes a cylindrical container portion 12, a light source 14, a closure cap 16 and a lamp 46. This embodiment also has smooth sides 502 on the open end of the container portion 12 that frictionally couple the container portion 12 to the corresponding smooth inner surface 504 of the closure cap 16. In this embodiment, the holding portion 28 is adapted to hold a lipstick 506 or the like. Moreover, the container portion 12 is rotatable relative to the light source 14, such that the lipstick 506 may be raised or lowered to a desired position suitable for application of the lipstick 506. In alternative embodiments, the holding portion 28 is adapted to hold an off-the-shelf lipstick and container, in which the lipstick container is rotated relative to the container portion 12 to raise or lower the lipstick. In further embodiments, the light source 14 may be contained in the closure 16 so that the light source 14 can be used to illuminate the lips as the lipstick 506 is applied.

Figure 12:
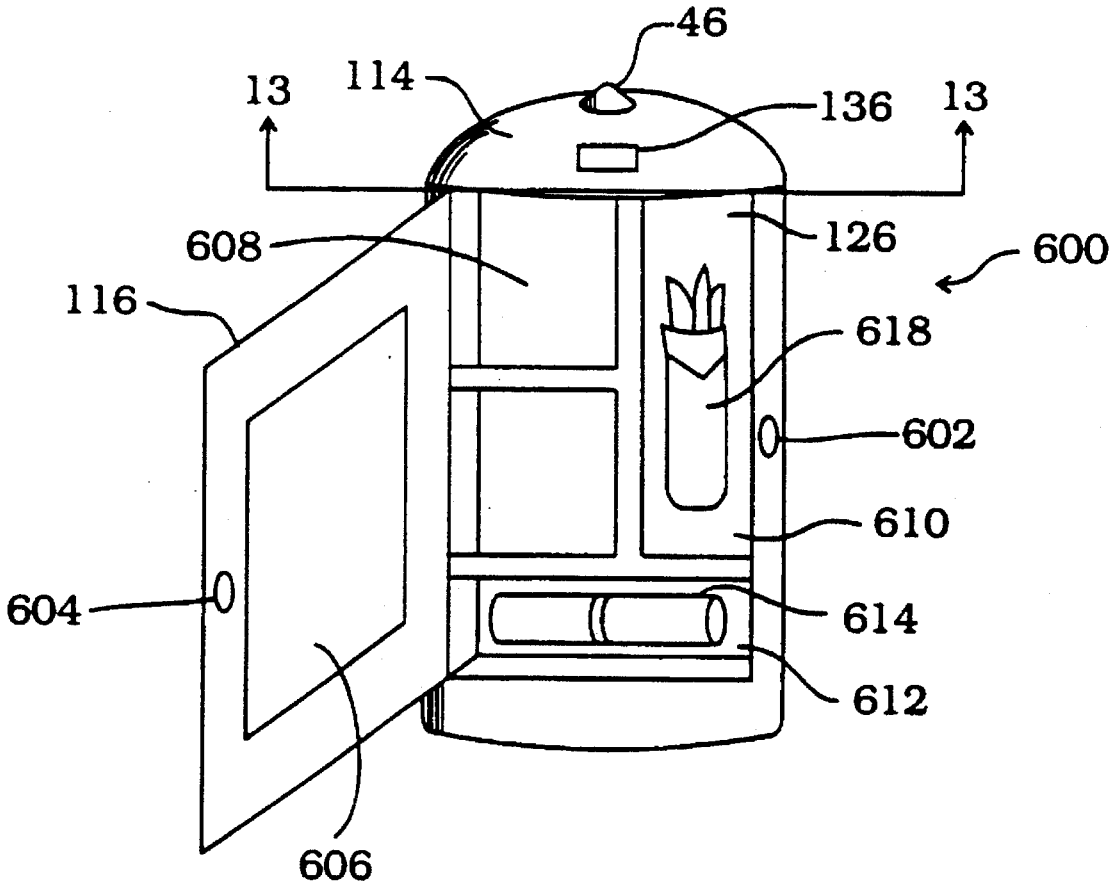
FIG. 12 is a perspective view of a multi-function container with a light source in accordance with a seventh embodiment of the present invention.
Figure 13:
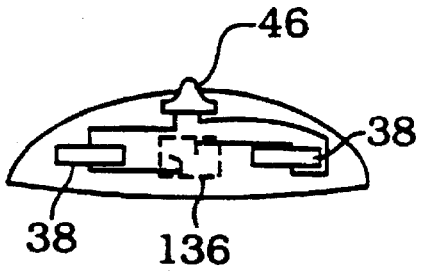
FIG. 13 is a partial cross-sectional view as shown along the line 13—13 in FIG. 12.

FIG. 12 is a perspective view of a multi-function container 600 with a light source 114 in accordance with a seventh embodiment of the present invention, and FIG. 13 is a partial cross-sectional view as shown along the line 13—13 in FIG. 12. This embodiment is similar to the embodiment illustrated in FIGS. 5 and 6. This embodiment includes at least one battery 38, a lamp 46, a closure panel 116, a holding compartment 126 and a light switch 136 as described above. However, this embodiment is adapted for holding a make-up kit or the like. As shown in FIG. 12, the holding compartment 126 has a magnetic catch 602 which corresponds and couples to a metal plate 604 on the closure panel 116. In alternative embodiments, the closure mechanism described for the embodiment shown in FIGS. 5 and 6 may be used. The closure panel 116 also includes a mirror 606 affixed to the inner surface of the closure panel 116 to aid the user in applying make-up. The holding compartment 126 is divided into a plurality of individual sections including make-up sections 608 for holding eye make-up, rouge or the like, an applicator section 610 for holding a make-up brush 618 or the like, and an accessory section 612 for holding a lipstick 614, a multi-function container 400, a multi-function container 500 or the like. This provides the user with a make-up kit and a light source in one article. In alternative embodiments, the multi-function container 600 may be coupled to a key ring support to allow the multi-function container 600 to be coupled to other articles. In still further embodiments, the multi-function container 600 may be adapted to hold items other than make-up, such as first aid kits (including bandages, gauze, disinfectant, tape scissors and the like), survival kits (including water, food rations, blankets, radios and the like), sewing kits (including needles, thread, buttons, patches and the like), shaving kits (including razor, cloths, after shave, shaving cream and the like), or the like.

Figure 14:
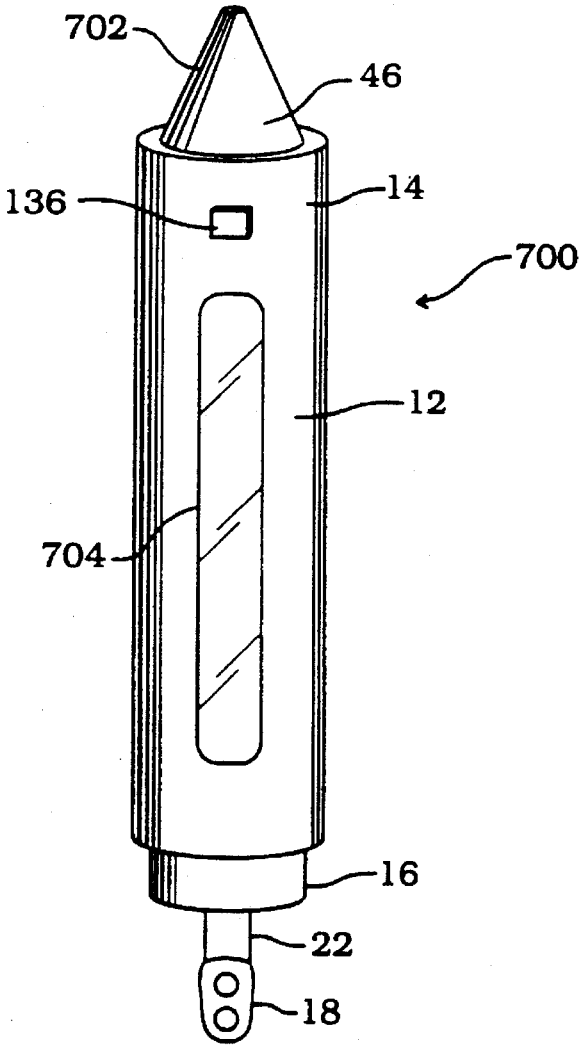
FIG. 14 and 15 are perspective views of a multi-function container with a light source in accordance with an eighth embodiment of the present invention.
Figure 15:
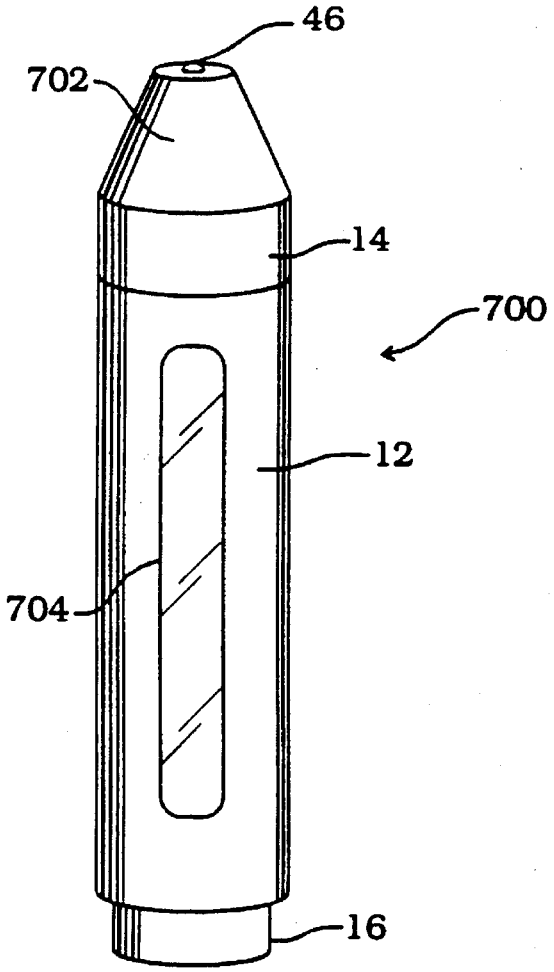

FIGS. 14 and 15 are perspective views of a multi-function container 700 with a light source 14 in accordance with an eighth embodiment of the present invention. This embodiment includes a cylindrical container portion 12, a light source 14 and a closure cap 16 as described above in the previous embodiments of FIGS. 1–4. However, the embodiments illustrated in FIGS. 14 and 15 have a light cone 702 coupled to the top of the light source 14. This provides a container that simulates the appearance of a pencil, crayon, markers or the like. These particular embodiments would appeal to young children who, for example, can utilize the multi-function container to hold their crayons in the large crayon-like container and have a light to illuminate their work. To further simulate a large pencil or crayon, appropriate lettering 704 may be disposed on the side of the cylindrical container portion 12. In particular embodiments, the closure cap 16 may be coupled to a key ring support member 18 and mounting member 22 as shown in FIG. 14 or it may utilize a plain closure cap 16 connected by threads or friction. The multi-function container 700 may be formed in a variety of sizes to accommodate various quantities of pencils and crayons, and it may be produced in a variety of colors. In particular embodiments, the multi-function container 700 may also hold paper, coloring books, games or the like. In preferred embodiments, the lamp 46 is placed at the top of the cone 702 (as shown in FIG. 15) to illuminate desired areas. However, in alternative embodiments, the lamp 46 may be recessed inside the cone 702 (as shown by the dotted lines in FIG. 14) to illuminate the cone 702 from the inside and give the cone 702 an appearance of glowing, and in still further embodiments, the cone 702 may also have an opening at the top to allow light to escape the cone 702 and illuminate various areas.

Figure 16:
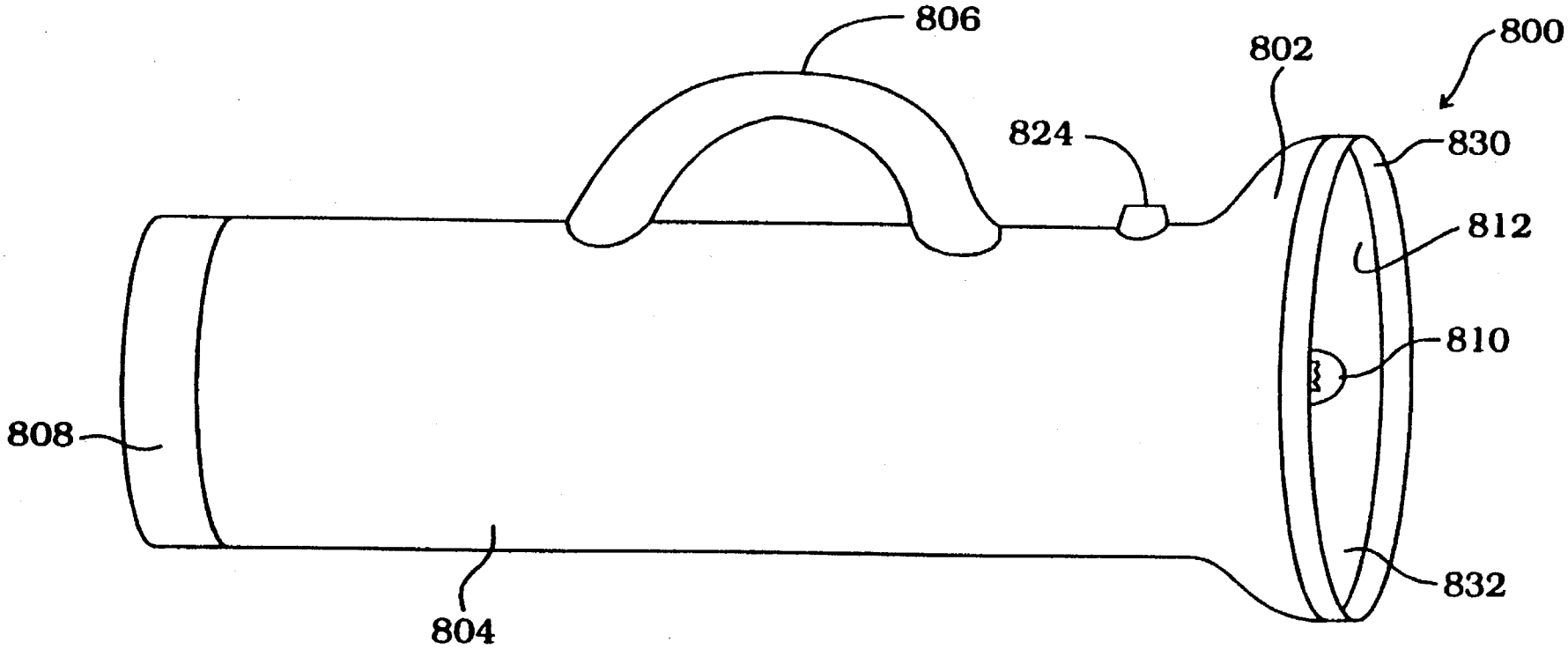
FIG. 16 is a perspective view of a multi-function container with a light source in accordance with a ninth embodiment of the present invention.
Figure 17:
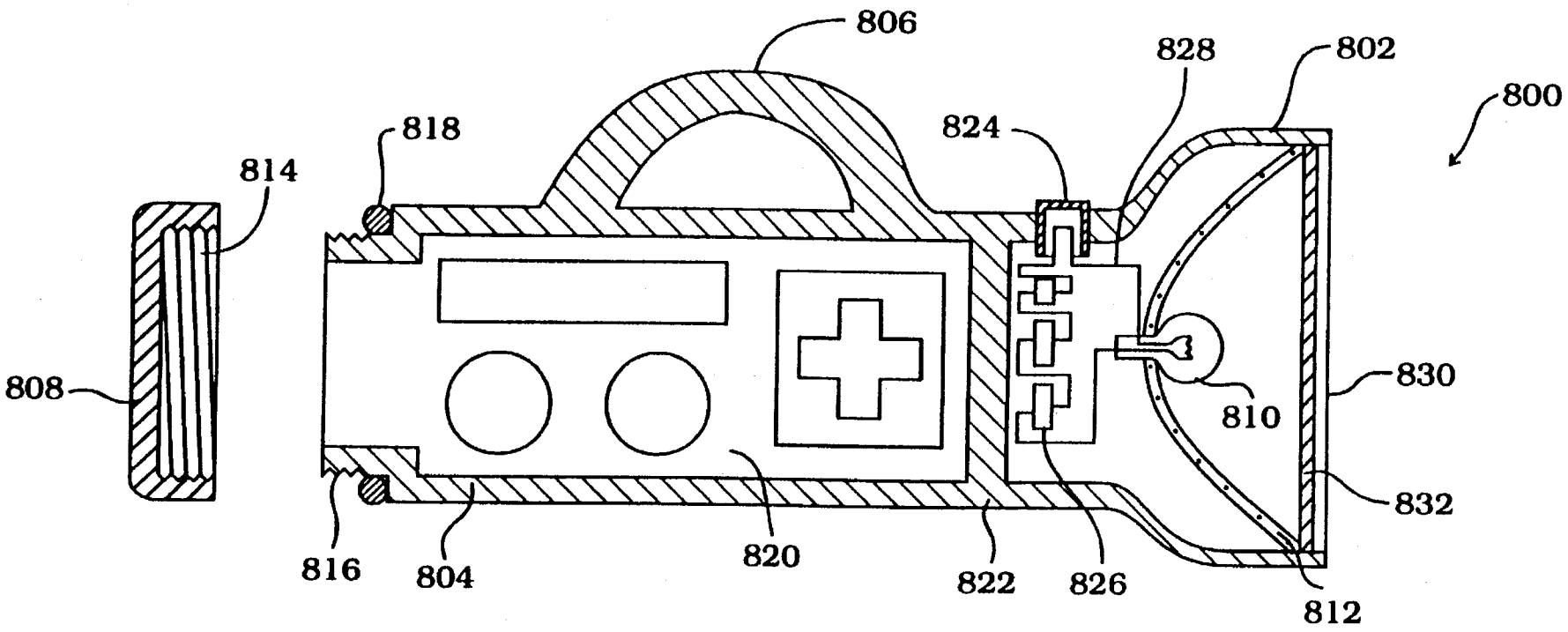
FIG. 17 is an exploded cross-sectional view of the embodiment shown in FIG. 16.

FIG. 16 is a perspective view of a multi-function container 800 with a light source 802 in accordance a ninth embodiment of the present invention, and FIG. 17 is an exploded cross-sectional view of the embodiment shown in FIG. 16. This embodiment is directed towards a multi-function container 800 that is sized and shaped along the lines of a traditional camping lantern or flashlight. The multi-function container 800 includes a light source 802, a container portion 804, a handle 806 and a closure cap 808. The light source 802 is coupled to the container portion 804 and includes a lamp 810 and a reflector 812. In preferred embodiments, the light source 802, the container portion 804, the handle 806 and the closure cap 808 are formed from plastic, such as high impact polystyrene, polycarbonate, poly-propylene, ABS plastic, or the like. However, other embodiments are formed from metals, such as stainless steel, aluminum or the like; ceramics or a combination of these materials or other suitable materials. In particular embodiments, the lamp 810 may be a standard flashlight lamp, halogen bulb or the like, and the reflector may be made from metal, glass, plastic or other suitable materials.

The handle 806 is coupled to the container portion 804 to aid in carrying and directing the lantern. In preferred embodiments, the handle 806 is formed as an integral part of the container portion 804. In alternative embodiments, shoulder strap connectors may be attached to the container portion 804 to allow the multi-function container 800 to be slung over the shoulder.

The closure cap 808 is coupled to the container portion 804 by inner threads 814 that correspond to threads 816 on the open end of the container portion 804. In alternative embodiments, the closure cap 808 may be coupled by other methods, such as friction, lugs and slots or the like. The closure cap 808 provides a weatherproof seal by contacting and compressing a gasket 818 or the like against the container portion 804 to seal out moisture, dirt and debris.

The container portion 804 has an interior holding portion 820 that is separated from the light source 802 by a separation barrier 822 that prevents contact or contamination between the items in the holding portion 820 and the circuit elements of the light source 802. The holding portion 820 is adapted to hold small items, such as survival gear (including blankets, water, emergency rations or the like), auto/motorcycle repair kits (including patches, air inflation cans, tape, fuses and the like), or the like. Thus, a user has one self contained kit that provides light and holds a kit suitable for emergency or camping situations. In alternative embodiments, the holding portion 820 and the barrier 822 may be adapted to house a radio (not shown) that can be operated through controls that are mounted on the exterior surface of the container portion 804.

A simplified schematic of the light source 802 is illustrated in FIG. 17. The light source 802 has a light switch 824 that turns the lamp 806 on and off. In preferred embodiments, the light source 802 may be switched from on, off and blinking states. In alternative embodiments, the light source 802 may be activated by rotating the light source 802 relative to the container portion 804, in a manner similar to that described above in FIGS. 1–4. The light source 802 is powered by a plurality of thin high power batteries 826 that take up a minimum amount of space so that the holding portion 820 in the container portion 804 is maximized for holding items. In preferred embodiments, the batteries 826 are lithium batteries or the like, and have a battery shelf life of approximately 5 years. The circuit is completed by connecting the batteries 826 in series by a plurality of wires 828. In particular embodiments, access to the interior of the light source 802 is obtained by unscrewing a bezel 830 that holds a transparent shield or lens 832. Once removed the batteries 826 and the lamp 810 can be changed in a manner similar to those used in traditional flashlights or lanterns. In alternative embodiments, the light source 802 may be powered with rechargeable batteries that can be charged from an automobile cigarette lighter or the like, or the light source 802 may be powered directly by an automobile cigarette lighter or the like.

Figure 18:
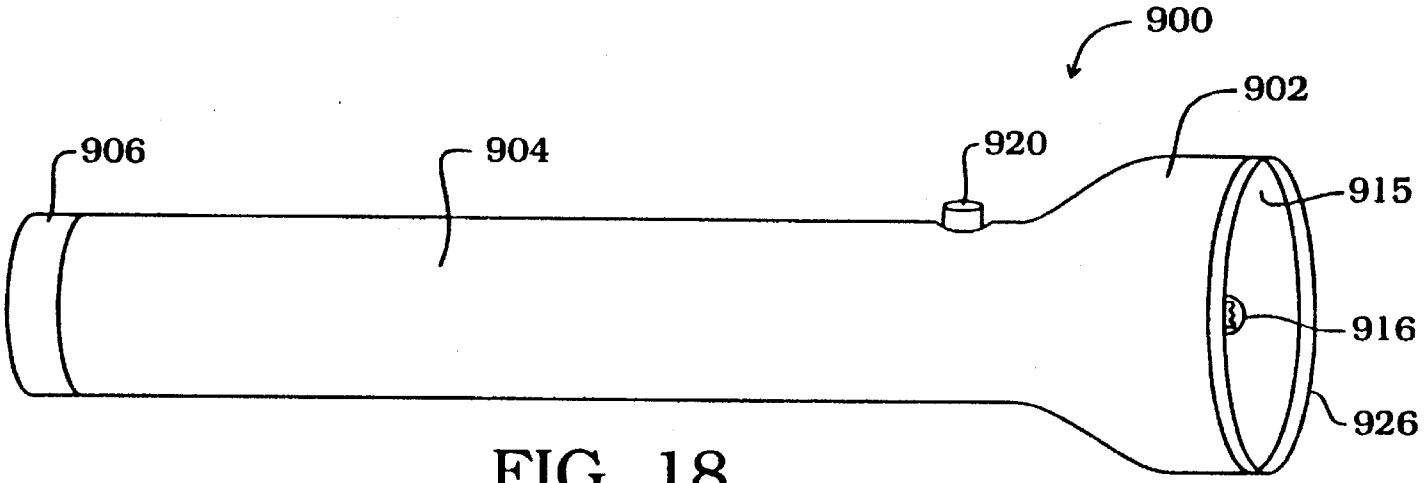
FIG. 18 is a perspective view of a multi-function container with a light source in accordance with a tenth embodiment of the present invention.
Figure 19:
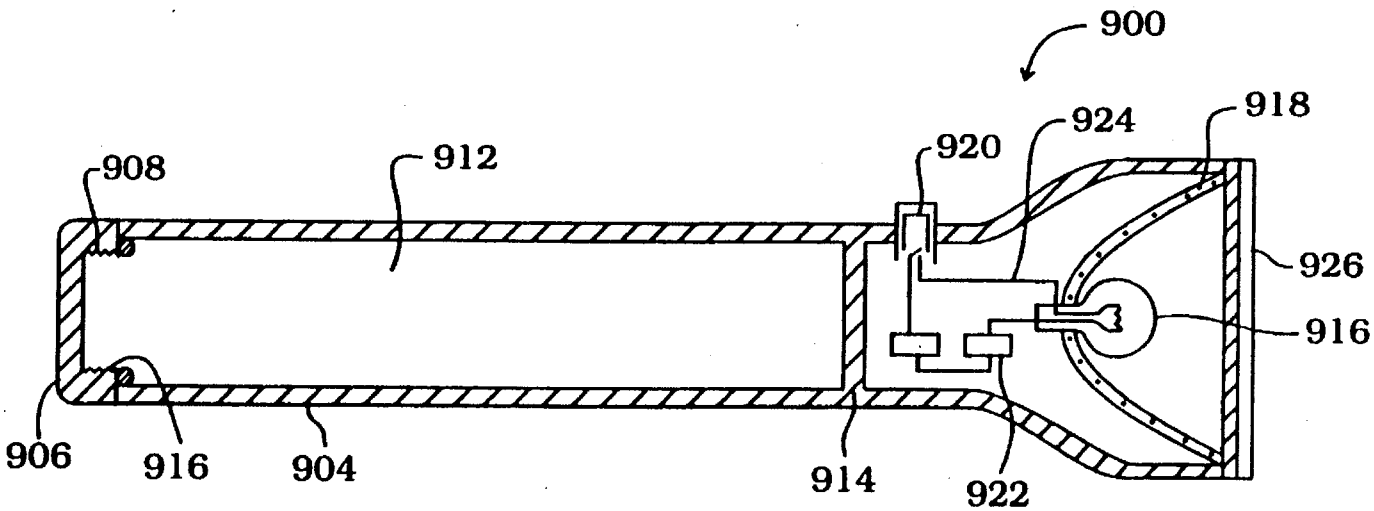
FIG. 19 is a cross-sectional view of the embodiment shown in FIG. 18.

FIG. 18 is a perspective view of a multi-function container 900 with a light source 902 in accordance a tenth embodiment of the present invention, and FIG. 19 is a cross-sectional view of the embodiment shown in FIG. 18. This embodiment is similar to the embodiment illustrated in FIGS. 16 and 17, and includes a light source 902, a container portion 904 and a closure cap 906. The multi-function container 900 is formed to more closely resemble a traditional flashlight, and thus has a long slender container portion 904. The closure cap 906 is secured by threads 908 that correspond to threads 910 on the open end of the container portion 904. The container portion 904 has an interior holding portion 912 adapted for holding small items, and which is separated from the light source by a barrier 914. The light source 902 has a lamp 916, a reflector 918, a light switch 920, and a plurality of batteries 922 connected by wires 924. The light source 902 works in a manner similar to that described in the embodiment illustrated in FIGS. 16 and 17. This embodiment is adapted to replace common flashlights and provide a storage capability to hold small items, such as tools, survival kits (including water, food rations, blankets and the like) or the like. The multi-function container 900 can also be utilized as a small article hiding place, since thieves may be less likely to look for valuables in an ordinary looking flashlight. The closure cap 906 in this embodiment is shown without a key ring holder or the like; however, in other embodiments, the closure cap 906 may be coupled to a key ring support or the like.

It will be recognized that certain features shown and described for each embodiment in FIGS. 1–19 may be interchanged or added to the various other embodiments shown in these Figures. It will also be recognized that the particular small items, such as candy, medicine tablets, make-up, perfume, pencils, crayons, survival kits (including water, food rations, blankets and the like), repair kits (including patches, tape, fuses and the like), or the like, shown with the particular embodiments may also be contained in the other embodiments shown in the Figures.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A multi-function container, comprising:

a unitary housing with an interior portion having an impermeable closed top end wall forming a barrier with a coupling surface that is on an opposite side of the interior portion, and the housing also including a side adjacent to the closed top end wall and having an opening leading to the interior portion of the housing and which is oriented oblique to the closed end wall;

a hinged resealable closure adapted to be coupled and secured to the opening leading to the interior portion of the housing to cover and seal off the interior portion of the housing;

an exterior light source containing at least one light generating source and which is coupled to the coupling surface of the impermeable closed end wall of the container, wherein the light source is capable of being operatively coupled to a power source contained between the light generating source and the impermeable closed end wall of the housing; and a key ring support coupled to an exterior surface of the container.

2. A multi-function container according to claim 1, wherein the housing is rectangular and box-shaped, wherein the box-shaped housing has a top and a side adjacent to the top, and wherein the interior portion is located at the side and the exterior light source is located at the top of the box-shaped housing.

3. A multi-function container according to claim 2, wherein the side has an edge and the closure is coupled to a side edge of the side of the box-shaped housing to cover the interior portion of the housing.

* * * * *